US005152233A

United States Patent [19]

Spisak

[11] Patent Number: 5,152,233

[45] Date of Patent: Oct. 6, 1992

[54] METHOD OF DEVOLATILIZING EARTH SOLIDS AND MOBILE TRUCK FOR CARRYING OUT THE METHOD

[75] Inventor: Douglas J. Spisak, Pittsburgh, Pa.

[73] Assignee: Heyl & Patterson, Inc., Pittsburgh, Pa.

[21] Appl. No.: 828,231

[22] Filed: Jan. 30, 1992

[51] Int. Cl.[5] ..... F23D 14/00

[52] U.S. Cl. ..... 110/240; 110/229; 110/236; 110/246; 110/346

[58] Field of Search ..... 110/236, 346, 229, 246, 110/240, 241

[56] References Cited

U.S. PATENT DOCUMENTS

| | | | |
|---|---|---|---|
| 4,957,429 | 9/1990 | Mendenhall | 110/236 X |
| 4,974,528 | 12/1990 | Barcell | 110/246 X |
| 5,005,495 | 4/1991 | Feitel | 110/204 X |
| 5,072,674 | 12/1991 | Noland et al. | 110/229 X |

*Primary Examiner*—Edward G. Favors

*Attorney, Agent, or Firm*—Harry B. Keck

[57] ABSTRACT

Earth solids which have been contaminated by volatile organic contaminants can be treated by a method and in an apparatus of this invention. The apparatus includes a rotary kiln, a baghouse filter, a high temperature incinerator and a recycle conduit to recycle a major portion by volume of the hot exit gases from the rotary kiln back to the gas inlet end of the rotary kiln. The remainder of the rotary kiln exit gases is delivered through a baghouse filter to remove gas-borne particulates and the substantially particulate-free kiln exit gas is discharged through a high temperature incinerator which converts unburned volatile organic contaminants to innocuous products of combustion. Recycling the kiln exit gas to the gas inlet end of the kiln permits use of a larger kiln with accompanying increased solids throughput by permitting use of smaller baghouse filters and a smaller incinerator. In the preferred embodiment the entire system preferably is mounted on a frame suitable for highway mobility.

8 Claims, 4 Drawing Sheets

METHOD OF DEVOLATILIZING EARTH SOLIDS AND MOBILE TRUCK FOR CARRYING OUT THE METHOD

BACKGROUND OF THE INVENTION

1. Field of the Invention

This invention concerns a method for devolatilizing earth solids, and more particularly to a novel sequence of known procedures which achieve a high throughput of solid treatment in equipment which can be constructed and operated on a frame of a wheeled vehicle.

2. Description of the Prior Art

There are many environmentally unsatisfactory accumulations of volatile organic liquids which have penetrated into earth soil, representing accumulations of decades of dumping or leaking with lack of concern for the environment. Some sites have been cleaned by digging out the contaminated earth and removing it to appropriate landfills. Some sites have been cleaned by digging out the contaminated earth solids and treating the solids in a local or remote site where the solids are heated to devolatilize the contaminating volatilizable organic materials. Such processes have been called "soil remediation". Several proposals for mobile mounted units have been advanced. BARCELL U.S. Pat. No. 4,974,528; MUDD et al U.S. Pat. No. 4,648,333; CROSBY et al U.S. Pat. No. 5,052,858.

A need continues for a soil remediation process which can be provided on a mobile highway-vehicle and which will have a significant solids throughput; will convert contaminated earth solids to acceptable earth solids which can be immediately restored to the earth at the site; and which yields combustion gases which are acceptable for discharge into the atmosphere.

STATEMENT OF THE PRESENT INVENTION

The present invention permits a high solids throughput for a mobile soil remediation installation as a result of permitting use of increased diameter rotary kiln apparatus. As a general rule, the diameter and length of a rotary kiln determine the solids throughput limits.

According to this invention, earth solids containing volatile organic contaminants are introduced into the upper end of a rotating kiln and are advanced toward the lower end of the rotating kiln. Hot gases provide a temperature within the rotating kiln sufficient to release organic contaminants in the earth materials. The hot gases result from burning fuel oil or fuel gas with air and directing the flame and hot gases into the interior of the rotating kiln. The kiln exit gases from the upper end of the kiln contain products of combustion of the fuel oil or fuel gas (principally nitrogen, steam and carbon dioxide and unconsumed oxygen) released organic compounds which have been heated and driven from the earth solids; and some airborne particles of the earth materials. A major portion (first portion) of the kiln exit gases is directly recycled to the lower end of the rotating kiln to provide recovery of much of the intrinsic heat content of the kiln exit gases and to provide a substantially greater gas flow through the rotating kiln than could be accomplished by the products of combustion, alone. A minor portion (second portion) of the kiln exit gases is not recycled, but instead is treated by initially removing the airborne particles, for example, in a baghouse and thereafter incinerating the substantially solids-free gas which contains products of combustion of fuel oil or fuel gas (which occurred in the rotating kiln); and released organic compounds (which have been driven off from the earth solids in the rotating kiln). Some of the volatile organic compounds may have been burned in the rotating kiln if there is an excess of oxygen in the kiln environment. If partial combustion occurred, then the products of that partial combustion also are included in the substantially solids-free gas which is incinerated. An incinerator is provided which is supplied with additional fuel oil or fuel gas and combustion air to burn the unburned constituents of the substantially solids-free second portion of the kiln exit gases and to develop an elevated temperature of 1500° F. or higher, in the incinerator. The resulting products of combustion from the incinerator can be discharged to the atmosphere.

The earth solids which are recovered from the lower end of the kiln are substantially free of volatile organic compounds. The devolatilized earth solids are collected and cooled, preferably by means of water sprays and can be re-introduced into the ground whence they originated or can be accumulated for redistribution at the remediation site.

As a result of the sequence of processing, the present process achieves substantially higher earth solids throughput than prior mobile earth solids remediation installations. The principal features of the present process are:

A. Directly recycling a major (first) portion of the kiln exit gases without deliberate cooling of the kiln exit gases to the bottom end of the kiln; and B. Removing solids from the remaining minor (second) portion of the kiln exit gases prior to incineration of the gases. The size of the incinerator and the kiln burner is reduced and the need for wet washing the exhaust gases is eliminated.

These and other objects and advantages of the present invention will become apparent from the following detailed description by reference to the drawings.

DESCRIPTION OF THE PREFERRED EMBODIMENTS

Figure 1:
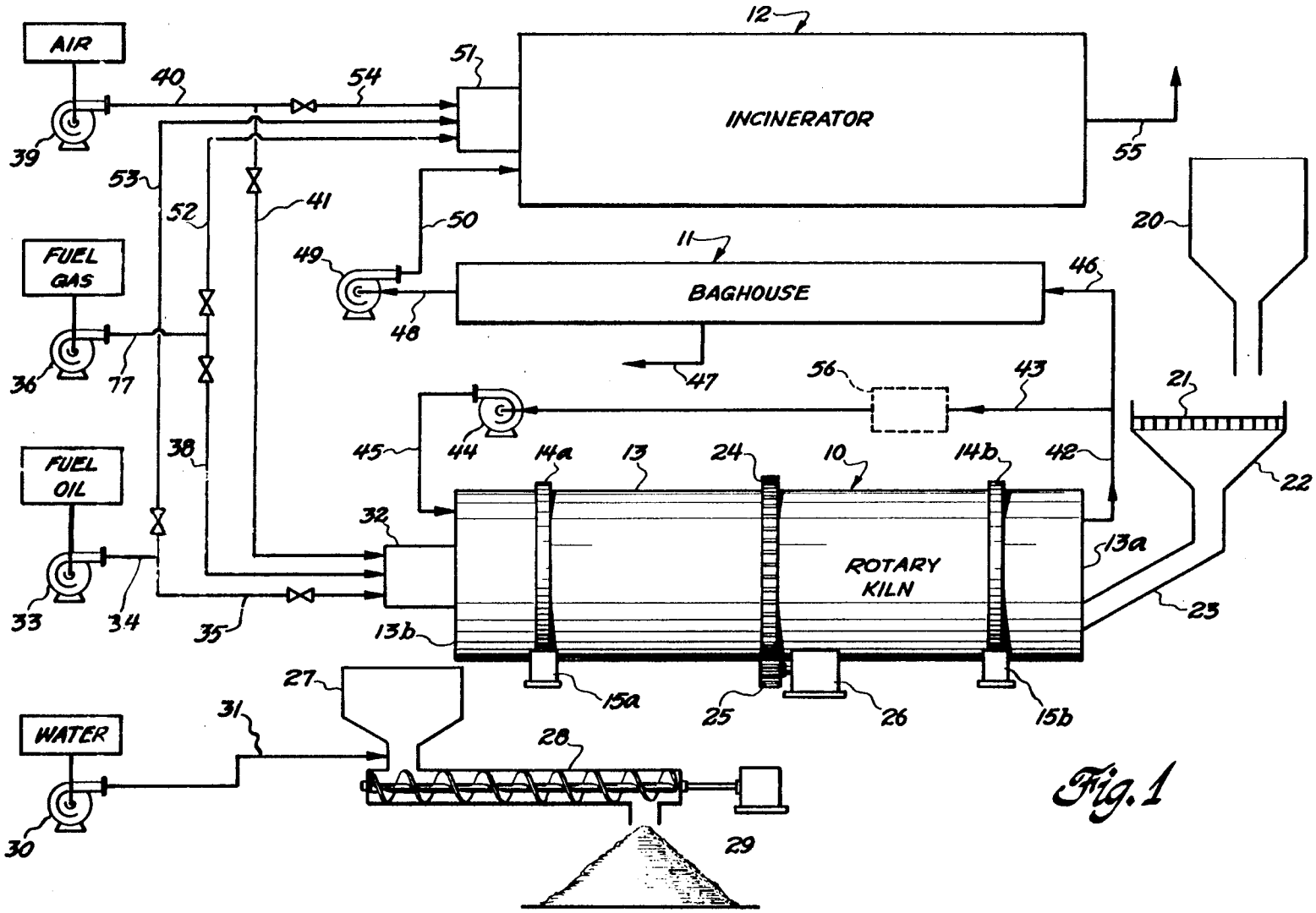
FIG. 1 is a schematic illustration of the process.

The present process is illustrated in FIG. 1 which presents a rotary kiln 10, a filter baghouse 11 and an incinerator 12. The rotary kiln 10, sometimes called a rotary dryer, is well-known and is useful for drying granular, crystalline or lumpy materials which are relatively free-flowing throughout the drying operation and which do not contain too large a proportion of dust. A rotary dryer consists essentially of a rotating cylinder 13 mounted on rollers 14*a*, 14*b*, 15*a*, 15*b* and inclined to the horizontal. Jacks are provided to elevate one end of the kiln 10. Material is fed at the upper end 13*a* and discharged at the lower end 13*b*. In the direct rotary dryer 10, hot gases pass through the dryer in direct contact with the material countercurrent to the material flow. The rotating cylinder is equipped with flights (not shown) on the inner surface which serve both to advance and to lift the material and shower it down through the hot gases. (Chemical Engineer's Handbook, John H. Perry, Second Edition, McGraw Hill Book Company 1941 page 1501.

A baghouse 11 also is well-known and includes a number of fabric bags or tubes, usually glass fiber fabric. Gases containing air-borne particles pass through the baghouse and exit from the baghouse substantially free of entrained particles. The particles cannot pass through the fabric of the bags or tubes. The bags or tubes are shaken periodically to separate particles from the surface of the bags or tubes and allow the particles to fall to the bottom of the baghouse where they can be collected and separately removed. With proper filtering fabric, the efficiency of a baghouse operation is high. It is customary to configure baghouses in pairs of filters so that one bag group may be functioning to remove particles while the other bag group is being shaken to separate particles from the fabric.

The incinerator 12 is a furnace maintained at an elevated temperature above 1500° F. by burning fuel oil or fuel gas within it and maintained in an oxidizing state (i.e., the furnace interior has excess oxygen to support combustion). Volatile gases are introduced into an incinerator for reaction therein with oxygen at elevated temperatures to convert the gas to harmless products of combustion.

Earth solids, containing volatile organic compounds are introduced into a hopper 20 onto a vibrating grizzly 21 to permit passage of grizzly undersize lumps of the earth solids into a feed hopper 22. The earth material is delivered from the feed hopper 22 through conduit means 23 into the upper end 13*a* of the rotary kiln 13. Preferably a rate controlling means (not shown) for delivering earth solids through the conduit 23 is provided, e.g., a conveyor or a helical drive screw, in order to control the rate of earth solids feed.

The rotary kiln 13 is provided with a toothed drive ring 24 which engages a gear 25 rotated by a motor 26. The rotating gear 26 drives the ring 24 to turn the kiln 13 about its central, longitudinal axis. While passing through the rotary kiln 13, earth solids are heated to an appropriate temperature for release of the volatile organic compounds, normally about 650° F. The earth solids, substantially free of volatile organic compounds, are recovered from the lower end 13*b* of the rotary kiln 13 in a product hopper 27. A suitable conveyor 28 delivers the clean earth solids into a pile 29 for reuse. Water is delivered to the hot earth solids through a conduit 31 to quench the hot, cleaned earth solids. A pump 30 may be employed to increase the water pressure. The water may be sprayed or otherwise applied to the earth solids at one or more locations between the product hopper 27 and the pile 29. The cleaned earth solids from the pile 29 may be returned to the site whence they originated or may be retained in the pile 29 until the remediation site has been restored and thereafter may be re-distributed to the cleaned site.

Heat for the rotary kiln 13 is supplied by burning fuel oil or fuel gas with air in a burner 32. A pump 33 delivers fuel oil through a conduit 34 and a valved conduit 35 to the burner 32. Alternatively a pump 36 delivers fuel gas through a conduit 37 and valved conduit 38 to the burner 32. Combustion air is delivered from a fan 39 through a conduit 40 and valved conduit 41 to the burner 32. The hot products of combustion from the burner 32 are delivered into the interior of the kiln 13 to maintain an appropriate temperature, customarily above 650° F. The kiln temperature is selected to achieve substantially complete release of the volatile organic compounds in the earth solids in the kiln 13. The kiln exit gases from the upper end 13*a* of the kiln 13 are delivered through a conduit 42. The kiln exit gases comprise the products of combustion of fuel oil or fuel gas with air; some air-borne particles of earth solids; and the volatile organic compounds which have been released from the earth solids in the hot kiln 13. Some of the volatile organic compounds may react in the kiln with excess oxygen to produce products of combustion. These combustion products of the volatile organic compounds will be in the kiln exit gases. The kiln exit gases also will contain recycled kiln exit gases.

A major portion (first portion) of the hot kiln exit gases from the conduit 42 is recycled through a conduit 43, a fan 44 and a conduit 45 which direct the gases to the lower end 13*b* of the kiln 13. The direct recycle of the kiln exit gases back to the kiln (a) salvages much of the intrinsic heat of those hot exit gases;

(b) provides significantly greater gas flow through the kiln 13 than would be achieved solely from the products of combustion from the burner 32;

(c) reduces the size of the incinerator 12 since it has less gas flow to treat.

A minor portion (second portion) of the kiln exit gases from conduit 42 is delivered through a conduit 46 to the baghouse 11. Within the baghouse 11, any entrained particles from the kiln exit gases are collected and recovered through a conduit 47 through which they may be delivered to the product hopper 27 or otherwise recovered. The baghouse exit gases, substantially free of entrained particles, are delivered through a conduit 48, fan 49 and conduit 50 to the incinerator 12 which has a burner 51. Fuel gas may be delivered to the burner 51 from the pump 36, conduit 37 and a valved conduit 52. Fuel oil may be delivered through the pump 33, conduit 34 and valved conduit 53 to the burner 51. Combustion air is delivered from the fan 39, conduit 40 and valved conduit 54 to the burner 51. Fuel gas or fuel oil is burned with combustion air in the burner 51 to develop a high temperature within the incinerator 12, preferably above 1500° F. Excess air is delivered through the valved conduit 54 so that the incinerator 12 will have sufficient excess oxygen to burn any unburned volatile organic compounds resulting from devolatilization of the earth solids in the kiln 13. The incinerator exit gases are delivered through a conduit 55 as harmless products of combustion. If the incinerator products of combustion in conduit 55 contain substantial sulfur or nitrogen oxides or halogen compounds, the incinerator exit gases may be diverted from the conduit 55 to appropriate gas cleaning equipment (not shown).

The principal features of the present process as schematically illustrated in FIG. 1 are:

(a) earth solids are freed from volatile organic compounds and may be returned directly or indirectly to the remediation site whence the earth solids originated;

(b) by recycling a major portion of the kiln exit gases directly to the lower end 13*b* of the kiln, it is possible to reduce the size of the required incinerator 12 and baghouse 11 and thereby to increase the diameter and length of the rotary kiln 13. In general, solids throughput in a rotary kiln is dependent upon the diameter and length of the kiln. The diameter and length of the kiln are correlated with the size of the incinerator and baghouse apparatus within restrictions of allowable width of a highway-transported mobile.

(c) By recycling a major portion of the kiln exit gases, much of the intrinsic heat of the kiln exit gases is salvaged.

(d) The higher throughput of this process permits more rapid remediation of identified remediation sites directly at the site.

If desired, a solids knockout device 56, e.g., baffles or similar impingement separators, may be placed in the recycle conduit 43 to eliminate some of the air-borne particles from the hot kiln exit gases prior to returning them to the kiln 13.

A preferred embodiment of the invention is illustrated in FIGS. 2, 3, 4, 5 including the unit includes a highway trailer 60 having a generally horizontal frame 61, rubber tired front wheels 62 and rubber tired rear wheels 63. Mounted on the frame 61 are:

a rotary kiln 64;

an incinerator 65;

a fuel burner 66 for the incinerator 65;

a pivotal stack 67 for the incinerator 65;

a fuel pump 68;

a feed hopper 69 to receive contaminated earth solids;

a helical screw 70 or belt conveyor from the feed hopper 69 to the rotary kiln 64;

a kiln exhaust gas duct 71;

a recycle duct 72 communicating with the kiln exhaust gas duct 71 and with the rotary kiln 64 at the gas inlet end thereof;

parallel baghouses 73*a*, 73*b*;

exhaust ducts 74*a*, 74*b* connecting the kiln exhaust gas duct 71 to the baghouses 73*a*, 74*b* respectively;

a fuel burner 75 receiving fuel from a fuel pump 68, receiving air from an air fan 77 and delivering a flame into the interior of the rotary kiln 64;

a dust collection channel 78*b* for collecting dust from the baghouse 73*b* (Note: a corresponding dust collection channel is associated with the other baghouse 73*a*, but is not shown on the drawings);

a helical screw 79 in the dust collection channel 78*b* to deliver the accumulated dust to a collection port 80 (Note: a similar helical screw is provided in the dust collection channel beneath the baghouse 73*b*);

a product discharge port 81 for delivering hot decontaminated earth solids.

The assembly of the components in FIGS. 2, 3, 4, 5 permits a significant solids throughput by accommodating a large size kiln 64. The large size kiln 64 is available because of the relatively small baghouses, 73*a*, 73*b* and the relatively small incinerator 65. In a typical installation, the rotary kiln 64 has a diameter of 6 feet and a length of 24 feet which accommodates 30,000 lbs per hour of contaminated earth solids. The overall length of the highway trailer 60 is 52.5 feet; the overall height of the highway trailer 60 is 13.5 feet (with the pivotal stack 67 in its inactive position). The overall width of the highway trailer 60 is 11.5 feet, the trailer frame 61 is 8.5 feet wide.

The feed hopper 69 includes a grizzly which passes four inch material to be processed.

The rotary kiln 64 is fabricated from ⅜ inch mild steel and has peripheral kiln mounting tires 82*a*, 82*b* and a driven gear 83. An electric motor 85 and drive gear 86 are mounted on the frame 61 to turn the driven gear 83.

The incinerator has an internal ceramic lining rated for 1800° F. service.

Figure 2:
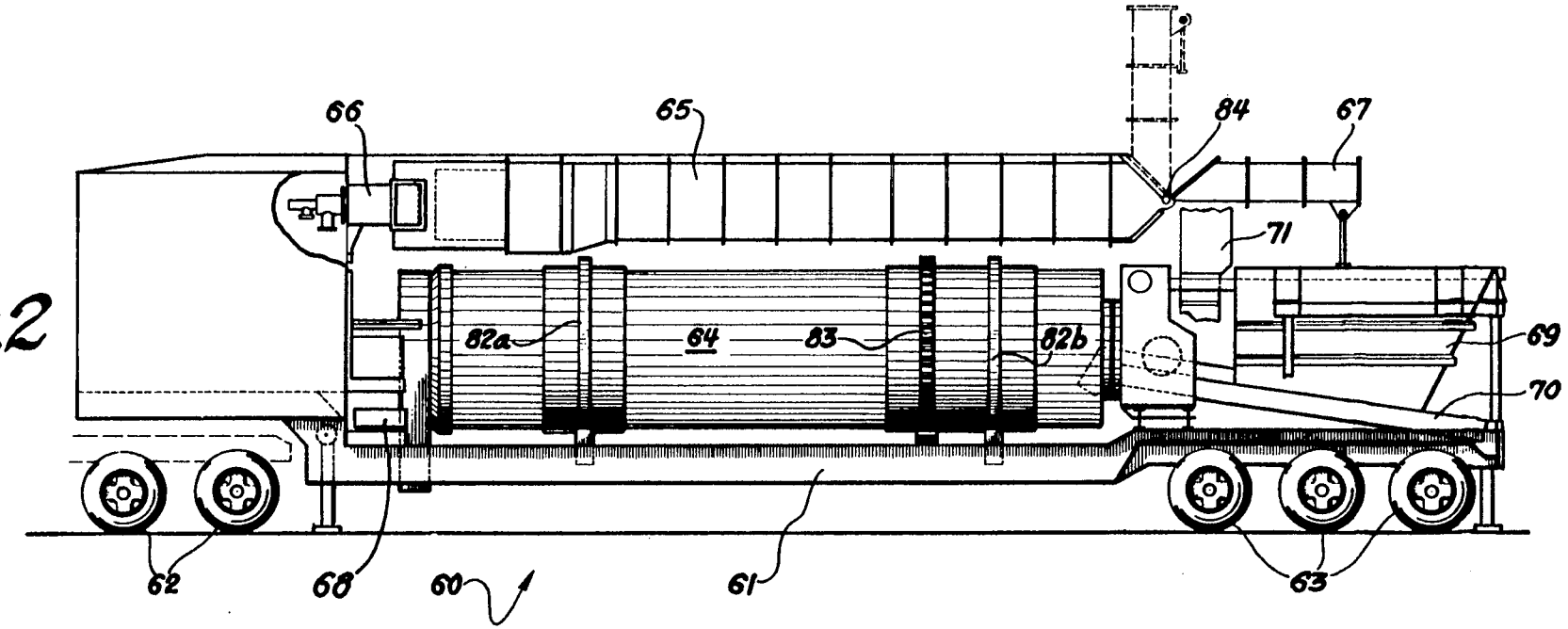
FIG. 2 is a side elevation of a highway trailer containing some of the apparatus embodying the invention.
Figure 3:
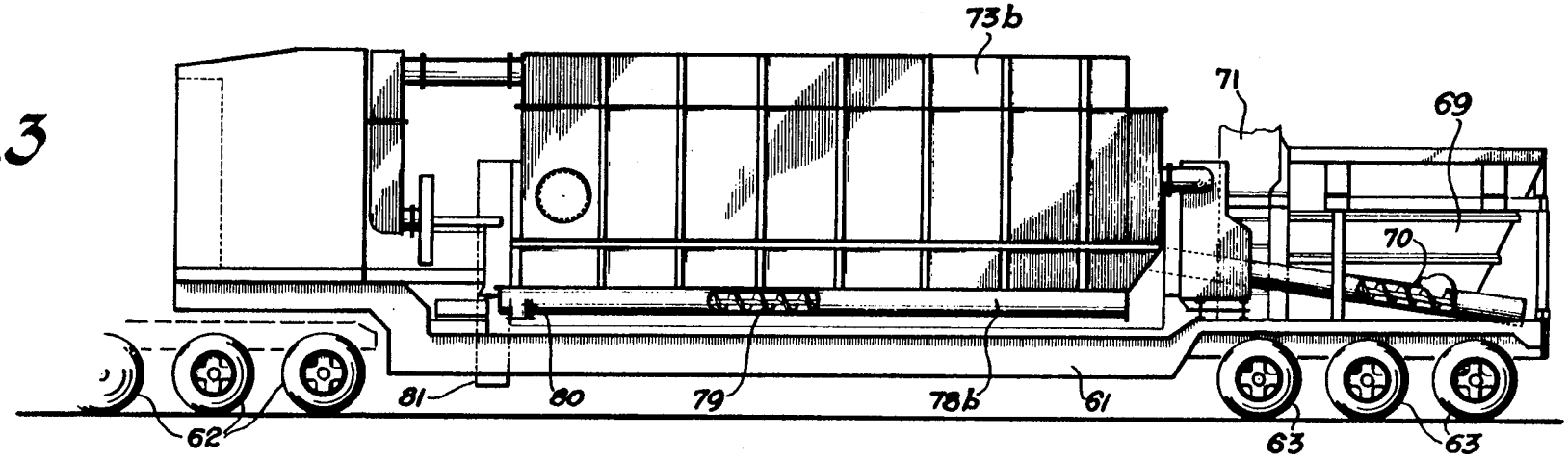
FIG. 3 is a side elevation of the highway trailer of FIG. 2 with baghouses in position.
Figure 4:
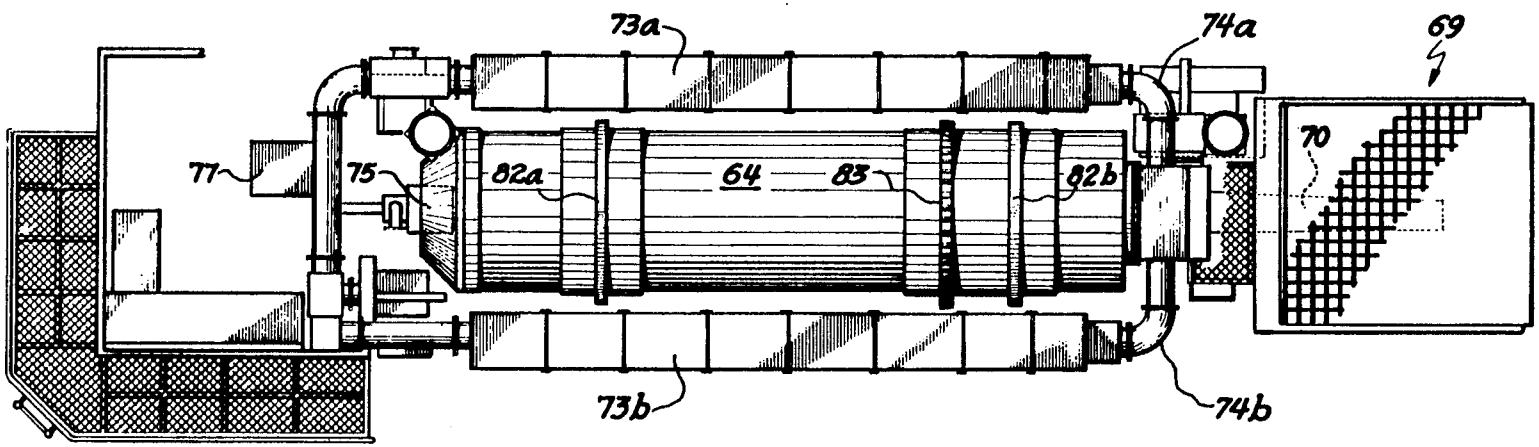
FIG. 4 is a plan view of the highway trailer of FIG. 2 with recycle ducts removed.
Figure 5:
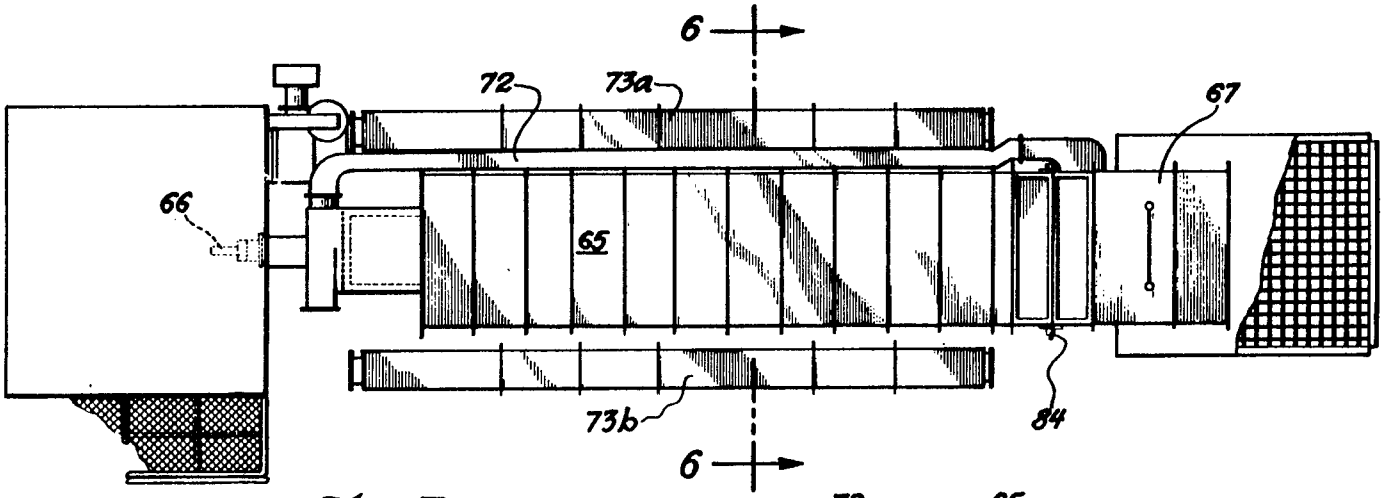
FIG. 5 is a plan view of the highway trailer of FIG. 2 with recycle ducts in position.
Figure 6:
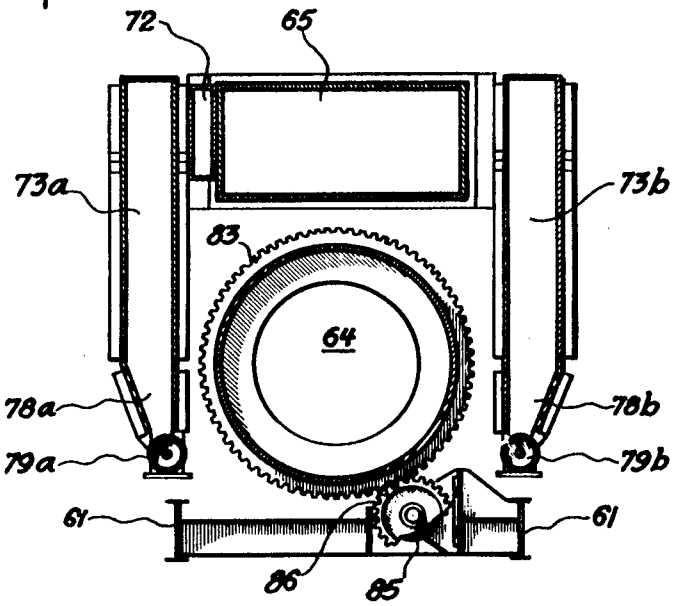
FIG. 6 is a sectional view taken along the line 6—6 of FIG. 5.

The pivotal stack 67 is shown in FIG. 2 in its inactive position. The pivotal stack turns about an axis 84 to the alternative operating location shown in phantom outline to deliver incinerator gases to the atmosphere. The incinerator gases may be treated as required prior to release to the atmosphere.

CONTROLS

Appropriate controls are provided with appropriate sensors to regulate:

1. Combustion air flow to kiln burner 75;
2. Fuel flow to an incinerator burner 66;
3. Fuel flow to the kiln burner 75;
4. Exhaust fan flow 44 (FIG. 1);
5. The feed rate for incoming contaminated solids;
6. flow rate of recycle kiln exit gases through recycle conduit 72.

SUMMARY

By employing a substantial recycle of hot kiln exit gases directly to the gas inlet end of the rotary kiln 64, a substantial gas throughput is maintained in the rotary kiln 64 and the rate of exhaust gas cleanup is lowered. The lowered flow rate of system exhaust gases (i.e., the incinerator exit gases) permits use of small baghouses 73*a*, 73*b* to recover the gas-borne particulates prior to incinerating the exhaust gases. The particulate-free exhaust gases from the incinerator can be discharged directly into the atmosphere. By maintaining a residence time of at least one second and a temperature of at least 1500° F. in the incinerator 65, all of the volatile contaminants from the kiln exit gas will be converted to innocuous products of combustion, usually requiring no supplemental treatment for environmental acceptability.

It will be observed that the preferred embodiment has a centrally mounted cylindrical rotary kiln which has its rotational axis aligned with a lengthwise axis of the frame. The baghouses are secured to the frame on each side of the rotary kiln. The incinerator is mounted on the frame above the rotary kiln. The kiln exhaust gas is divided between the recycle duct 72 and the exhaust ducts 74*a* or 74*b*. The baghouse gas outlet, the incinerator gas inlet and the rotary kiln gas inlet all are present at one end of the frame 61. Similarly the baghouse inlet, the incinerator outlet and the rotary kiln gas outlet all are present at the other end of the frame.

I claim:

1. A method for treating contaminated earth solids which contain volatilizable organic contaminants which comprises:

a. introducing said contaminated earth solids into a rotary kiln at a gas exit end thereof and removing uncontaminated earth solids from a gas inlet end thereof substantially free of said volatile organic contaminants;

b. introducing liquid or gaseous fuel and combustion air into said gas inlet end of said rotary kiln; burning said liquid or gaseous fuel and delivering hot combustion gases into said rotary kiln to heat said rotary kiln above the vaporization temperature for said volatilizable organic contaminants;

c. removing hot kiln exit gases from said gas exit end of said rotary kiln including products of combustion of said liquid or gaseous fuel, volatile organic gases and gas-borne solid particles from said earth solids;

d. recycling a major portion by volume of said hot kiln exit gases to said gas inlet end of said rotary kiln;

e. separating gas-borne solid particles from the remainder of said hot kiln exit gases;

f. collecting said solid particles and incinerating the remaining hot kiln exit gases to convert volatile organic gases to incinerator products of combustion;

g. discharging said incinerator products of combustion to the atmosphere.

2. The method of claim 1 wherein said gas exit end of said rotary kiln is elevated above said gas inlet end thereof, and rotating said rotary kiln to advance and tumble said earth solids therein.

3. The method of claim 1 wherein said first portion of said hot kiln exit gases is returned to said gas inlet end of said rotary kiln through a solids separating zone which removes a portion of gas-borne earth solid particles from said first portion.

4. The method of claim 1 wherein the separated gas-borne solid particles are mixed with said uncontaminated earth solids.

5. An apparatus for treating earth solids containing volatilizable organic contaminants which comprises:

a. a frame having wheels for mobility;

b. a rotary kiln having a gas inlet end and a gas exit end;

c. an incinerator;

d. a bag filter;

e. means for introducing contaminated earth solids into said gas exit end of said rotary kiln;

f. means for recovering earth solids, substantially free of volatilizable organic contaminants from said gas inlet end of said rotary kiln;

g. means for heating said rotary kiln comprising combustion air delivery means and liquid or gaseous fuel delivery means adapted to burn said fuel with said combustion air and to direct heat into said gas inlet end of said rotary kiln;

h. means at said gas exit end of said rotary kiln for recovering hot kiln exit gases including products of combustion, volatilized organic gases and entrained particles of said earth solids;

i. means for recycling a major portion by volume of said hot kiln exit gases to said rotary kiln through said gas inlet end thereof;

j. means for delivering the remainder of said hot kiln exit gases to said bag filter;

k. means for recovering said entrained particles of said earth solids from said bag filter;

l. means to deliver from said bag filter the remaining hot kiln exit gases, substantially free of entrained particles, to said incinerator which is maintained at a temperature sufficient to cause combustion of said volatile organic gases;

m. and means to discharge incinerator exit gases from said incinerator to the atmosphere.

6. Apparatus according to claim 5

When said bag filter is provided in two units, one on each side of said rotary kiln and said incinerator is provided above said rotary kiln.

7. Apparatus according to claim 5 when the gas inlet end of said baghouse and the gas exit end of said incinerator and the gas exit end of said rotary kiln are present at one end of said frame and the gas exit end of said baghouse and the gas inlet end of said incinerator and the gas inlet end of said rotary kiln are present at the other end of said frame.

8. Apparatus according to claim 5 including a solids feed hopper and a grizzly mounted on said frame adjacent to the gas exit end of said rotary kiln.

* * * * *